US006978963B2

(12) United States Patent
Suzuki et al.

(10) Patent No.: US 6,978,963 B2
(45) Date of Patent: Dec. 27, 2005

(54) WEB FEED METHOD AND WEB FEED APPARATUS

(75) Inventors: Masayoshi Suzuki, Hiroshima-ken (JP); Takeshi Matsuka, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/166,765

(22) Filed: Jun. 12, 2002

(65) Prior Publication Data

US 2002/0190153 A1 Dec. 19, 2002

(30) Foreign Application Priority Data

Jun. 13, 2001 (JP) ..... 2001/178026

(51) Int. Cl.[7] ..... B65H 19/10
(52) U.S. Cl. ..... 242/554.3; 242/555.5
(58) Field of Search ..... 242/554.3, 555.5, 242/555.6, 555.7

(56) References Cited

U.S. PATENT DOCUMENTS

| | | | | | |
|---|---|---|---|---|---|
| 1,699,928 | A | * | 1/1929 | Stone | 242/555.6 |
| 1,815,179 | A | * | 7/1931 | Ball et al. | 242/554.3 |
| 2,621,865 | A | * | 12/1952 | Wieking | 242/554.3 |
| 2,638,281 | A | * | 5/1953 | Tollison | 242/554.3 |
| 3,460,775 | A | * | 8/1969 | Ford et al. | 242/555.6 |
| 3,467,334 | A | * | 9/1969 | Chestnut et al. | 242/554.4 |
| 4,010,061 | A | * | 3/1977 | Tokuno | 156/504 |
| 4,543,152 | A | * | 9/1985 | Nozaka | 156/502 |
| 4,948,061 | A | * | 8/1990 | Krimsky et al. | 242/555.6 |
| 5,152,472 | A | * | 10/1992 | Spang et al. | 242/554.2 |

FOREIGN PATENT DOCUMENTS

| | | | | |
|---|---|---|---|---|
| CH | 580 529 | | 10/1976 | |
| JP | 02152850 | A * | 6/1990 | B65H/19/16 |
| JP | 06048620 | A * | 2/1994 | B65H/19/14 |

* cited by examiner

*Primary Examiner*—Donald P. Walsh
*Assistant Examiner*—Joseph Rodriguez
(74) *Attorney, Agent, or Firm*—Armstrong, Kratz, Quintos, Hanson & Brooks, LLP

(57) ABSTRACT

Continuous web feed is provided by using an apparatus for unwinding a web on a continuous basis by means of an automatic web splicing apparatus. An arm supporting a web roll is rocked when unwinding of the web is switched between web rolls. When the web is switched from one of web rolls (roll A) to the other (roll B), the remaining core of the web roll is removed subsequent to switching. Then the web roll installation position is shifted to the side reverse to the front and back of the web being unwound from the other web roll (roll B). After that, a new web roll is mounted in position. When the web is switched from the other web roll (roll B) to the web roll (roll A), the remaining core of the web roll is removed subsequent to switching. The web roll installation position is arranged in such a way that a new web roll is then mounted on the same side as the front and back of the web being unwound from the web roll.

5 Claims, 15 Drawing Sheets

Positional angle
0 deg.
-180 deg
+40 deg
-140 deg.
+140 deg
-360 deg
-320 deg
0 deg
Splice position
Wait position
Remaining core
6(2a)
6(2b)
n the middle of rotation
10
2a
2b
2a'
2b'
3
30

12
14A
15
12
X
Y
2b
3
30
30
2a
X
Y
2b
6(2a)
X
Y
2b
X
Y
2b
15A
2a'
X
Y
2a'
X
Y
2b
X
Y
2a'
6(2b)
X
Y
2b
X
Y
2a'
2b'
X
Y
2a'
2b'

18U
12U
3
2a
U
L
2b
12L
18L
30
6(2a)
6(2b)
2a'
2b'

WEB FEED METHOD AND WEB FEED APPARATUS

BACKGROUND OF THE INVENTION

1. Field of the Invention

The present invention relates to a web feed method and feed apparatus used in a printing machine.

2. Description of Related Art

A conventional web feed apparatus will be described with reference to FIG. 13 to FIG. 18.

FIG. 13 is a schematic drawing representing a continuous web feed apparatus 1*a* wherein a web 3 is attached to the tip of a new web roll 2*b* at zero speed when the amount of the web remaining on the web roll 2*a* feeding a running web 3 becomes small. FIGS. 14 and 15 are schematic drawings representing a continuous web feed apparatus 1*b* using a rotary arm 56 wherein web 3 is attached while the web 3 being fed is running. FIG. 16 shows an example of the shaft end of a support shaft 57 mounted on a web feed apparatus 1 using a rotating arm (R) 56 when electricity or fluid is supplied. FIG. 16(*a*) indicates the case where electricity is used, while FIG. 16(*b*) indicates the case where fluid such as compressed air or pressurized water is used. FIG. 17 is a schematic drawing representing a continuous web feed apparatus Ic, wherein the new web is attached to the web 3 while it is running, and the support shaft 57 of the rotary arm 56 supporting the web roll 2 does not penetrate the rotational center. FIG. 18 is a schematic drawing representing a continuous web feed apparatus Id in which web attachment is performed while the web 3 is running, and a rocking arm 59 (S) that does not rotate is used.

FIGS. 13(*a*) and (*b*) are schematic drawings showing a continuous web feed apparatus 1*a* in which the web 3 is attached at zero speed. The web 3 fed from the web roll 2*a* passes through an upper guide roll group 51 and a lower guide roll group 52 alternately, and is fed to the next apparatus over a long-distance route.

In the status shown in FIG. 13(*a*), when the amount of the web remaining on the web roll 2*a* becomes small and the roll 2*a* is to be switched over to a new web roll 2*b*, the web 3 stored in a web storage apparatus 50 is discharged by reducing the gap H between the upper guide rolls 51 and the lower guide rolls 52 as shown in FIG. 13(*b*). Then, web roll 2*a* is stopped and an automatic web connecting apparatus 30 is operated; then the running web 3 is pressed against the tip of a new web roll 2*b* by a pressing apparatus 37. When the web 3 on the side of the web roll 2*a* is cut off by a saw blade 38, the web 3 can be fed from the new web roll 2*b*. After that, the web storage apparatus 50 is returned to the original position (as shown in FIG. 13(*a*)) with the speed of web roll 2*b* being increased, and the web 3 is thus continuously fed. The amount of stored web is then brought to a maximum to become ready for the next attachment of a subsequent roll web.

Further, FIG. 14 shows the configuration in which attachment is carried out with the web 3 kept running, and the front and back surfaces of the web 3 to be fed are kept unchanged. The web attachment procedure can be briefly described as follows: Web 3 is supplied from the web roll 2*a* as shown in FIG. 14(*a*). When the amount of the web remaining on the web roll 2*a* becomes small as shown in FIG. 14(*b*), the new web roll 2*b* is driven so that its surface speed will be the same as that of running web 3. An automatic web attachment apparatus 30 is actuated and the running web 3 is pressed against the new web roll 2*b* by the pressing apparatus 37. After the running web 3 has been attached to the tip of the web on the new web roll 2*b*, the web 3 having been fed from the web roll 2*a* is cut off by the saw blade 38, and the web 3 then comes from new web roll 2*b*.

In the state shown in FIG. 14(*c*), a remaining web core 6 is removed by an unloading apparatus (not illustrated). As shown in FIG. 14(*d*), a new web roll 2*a*' ready for attachment at the tip of the web is mounted by a loading apparatus (not illustrated), and the arm 56 supporting the web rolls 2 is turned in the direction indicated by an arrow in the drawing so that the condition shown in FIG. 14(*b*) is realized. This procedure is repeated to feed the web 3 continuously. When a high-quality web is to be fed, a problem may occur if front and back sides are reversed by the splicing of web 3. This arrangement is preferable in the sense that such a problem can be avoided. In FIG. 14, a support shaft 57 supports the arm 56, and in FIG. 15, an arm rotating apparatus 58 is mounted on a frame 4.

A continuous web feed apparatus Ic in FIG. 17 has the same basic functions as those of the continuous web feed apparatus 1*b* given in FIGS. 14 and 15, the difference being found in the structure of the support shaft 57 and the overall size of the continuous web feed apparatus 1. Namely, in the continuous web feed apparatus 1*b* shown in FIGS. 14 and 15, the support shaft 57 penetrates across the width. Assume that the maximum diameter of web rolls 2 is "D", the diameter of the support shaft 57 at the center is "d", and the required minimum clearance is "C". Thus, one finds the maximum overall rotating dimension K to be given by K=2D+d+C. In the continuous web feed apparatus Ic shown in FIG. 17, on the other hand, the support shaft 57 is provided only on the outside with respect to the arms 56 located on the opposite sides across the width of web rolls 2, without any support shaft mounted inside (on the side of the web rolls). Beams 13 are installed separately. Thus, the maximum overall rotating dimension K equals 2D+C.

FIGS. 18(*a*) and (*b*) show a continuous web feed apparatus Id wherein the arm 59 supporting the web roll 2 feeds the web 3 continuously by rocking, not by rotation. This continuous web feed apparatus Id comprises (1) arms 59*a* and 59*b* supporting two web rolls 2*a* and 2*b*, respectively, (2) an automatic web splicing apparatus 30*a* for splicing the web 3*a* on the left to the new web roll 2*b*, and (3) an automatic web splicing apparatus 30*b* for splicing the web 3*b* on the right to the new web roll 2*b*. The arms 59*a* and 59*b* are supported by support shafts 60*a* and 60*b*, and are designed to rock about the support shafts 60*a* and 60*b*.

FIG. 18(*a*) shows how web 3 is unwound from the web roll 2*a*. When the amount of the web remaining on the web roll 2*a* becomes small, the surface speed of new web roll 2*b* is increased to reach the same speed as that of the running web 3*a*. The automatic web splicing apparatus 30*a* is pushed out in the arrow-marked direction, and the web 3*a* is pressed against the new web roll 2*b* by the pressing apparatus 37*a*. The web 3*a* is brought in contact with the tip of the web on the web roll 2*b*, and web 3*b* is unwound from the web roll 2*b*. At the same time, the web 3*a* having been unwound from the web roll 2*a* is cut off by the saw blade 38*a*. Then the web core remaining on the web roll 2*a* is removed by the unloading apparatus (not illustrated), and a new web roll 2*a*' is installed by the loading apparatus (not illustrated) as shown in FIG. 18(*b*). Further, when the amount of the web remaining on the web roll 2*b* becomes small, the surface speed of new web roll 2*a*' is increased to reach the same speed as that of the running web 3*b*. The automatic web splicing apparatus 30*b* is moved in the arrow-marked direction, and the web 3*b* is pressed against the new web roll 2*a*'. Then the web is spliced and switched in the same procedure as above.

In the aforementioned prior art web feed apparatus and feed method, however, a continuous web feed apparatus 1*a* shown in FIG. 13 requires that the dimensions of the web storage apparatus 50 represented by dimensions L and H shown in FIG. 13(*a*) be large in order to compensate for the time required in web splicing and switching by the amount of the stored web when the machine speed is increased. This, in turn, requires that the installation space be increased as the speed increases. Moreover, a required installation space is increasing due to the recent trend of increasing machine speeds.

Further, the continuous web feed apparatus 1*b* of rotary arm type shown in FIGS. 14 and 15 is equipped with many devices operated by electric and hydraulic means, such as (1) a device for moving the arm 56 to mount the web roll 2 on this arm 56 or moving the chuck supporting the core of the web roll 2, (2) a brake device for giving an appropriate tension to the web roll 2 unwinding the web 3, and (3) a driving device for acceleration of the new web roll 2. When electricity or fluid is supplied to the side of the rotating arm 56 from the power supply or fluid source provided on the stationary side (frame 4., etc.), a special apparatus as shown in FIG. 16 is required.

FIG. 16(*a*) shows a slip ring 53 as an example of the apparatus for transmitting electricity from the stationary side to the rotary side. This slip ring 53 is provided on the rotating support shaft 57 according to each type of electricity (having different signal, voltage, etc.) to be connected. It slides in contact with carbon, etc., whereby electricity is transmitted from the stationary side. However, it has a complicated structure and involves complicated procedures in the replacement of consumed carbon or in the maintenance work to keep the surface conductivity of the slip ring 53 in good conditions. This requires a great deal of time and costs. Further, it is difficult to maintain high performances of a high-precision control system 4 when the slip ring 53 is used, because of many problems; namely, insulation work is essential for a large capacity product, for example. Further, the installation space must be expanded.

FIG. 16(*b*) shows a rotary joint 54 as an example of the apparatus which feeds fluid from the stationary side to the rotating side. In this rotary joint 54, the pipe on the stationary side and individual flow paths provided on the rotating support shaft 57 are connected with each other. In this case, a clearance for rotation is required between the rotary portion and stationary portion. Presence of a clearance is accompanied by possible fluid leakage. So sealing material 55 for avoiding fluid leakage is necessary. However, sealing material 55 is a consumable component which requires maintenance work. At the same time, this increases rotational loads. Moreover, many flow paths requiring difficult machining work is required inside the support shaft 57; and this will increase costs. Further, similarly to the case of the aforementioned slip ring 53, the overall installation space must be increased since rotary joint 54 is provided.

In the continuous web feed apparatus Ic shown in FIG. 17, an improvement is found in the sense that the installation space is reduced; however, it still requires installation of the slip ring 53 for feeding the web 3 continuously by rotating the support shaft 57 mentioned in the description made with reference to FIGS. 14 and 15, and the installation of the rotary joint 54. Alternatively, when they are not installed, complete mechanical means must be used or power must be given from the outside so that the apparatus can be used within a limited space. These problems still remain to be solved.

In the continuous web feed apparatus Id shown in FIG. 18, the arm 59 rocks without rotating when the web roll 2 is switched. This eliminates the need of using the slip ring 53 or rotary joint 54 and provides a simplified structure, but the front and back of the running web 3 are reversed every time the web 3 is spliced and switched. This gives rise to a big problem depending on products in subsequent steps. For example, this will cause subtle differences on the front and back in the case of high quality printing. Moreover, two automatic web splicing apparatuses 30 must be installed, and this creates a problem of increased equipment costs.

SUMMARY OF THE INVENTION

The present invention has been made to solve the aforementioned problems, and the object thereof is to provide a web feed method and feed apparatus characterized by a reduced installation space, a simple structure and easy maintenance control, with the front and back of the continuously fed web kept unchanged.

To solve the problems of the aforementioned prior art, the present invention uses an apparatus for holding two web rolls and unwinding a web on a continuous basis by means of an automatic web splicing apparatus. Arms supporting the web rolls are rocked when the unwinding of the web is switched between the web rolls. When this web is switched from a first web roll (roll A) to a second web roll (roll B), the remaining core of the first web roll (roll A) is removed subsequent to switching. Then the installation position for the first web roll (roll A) is shifted onto the opposite side with respect to the web being unwound from the second web roll (roll B), then a new web roll is mounted in position to take the place of the first web roll. By contrast, when the web is switched from the second web roll (roll B) to the first web roll (roll A), the remaining core of the second web roll (roll B) is removed subsequent to switching, and the installation position for the new web roll is arranged in such a way that the new web roll is mounted to take place of the second web roll on the same side with respect to the web being unwound from the first web roll (roll A). The web is fed continuously in this manner.

As described above, the web feed method according to the present invention uses an automatic web splicing apparatus. Arms supporting the web rolls are rocked when unwinding of the web is switched from one roll to another. When the source of this web is switched from a first web roll (roll A) to a second web roll (roll B), the remaining core of the first web roll (roll A) is removed subsequent to the switching. Then the installation position for the first web roll (roll A) is shifted onto the opposite side with respect to the web being unwound from the second web roll (roll B), then a new web roll is mounted in position to take the place of the first web roll. In contrast, when the source of the web is switched from the second web roll (roll B) to the first web roll (roll A), the remaining core of the second web roll (roll B) is removed subsequent to the switching, and the installation position for the new web roll is arranged in such a way that the new web roll is mounted to take the place of the second web roll on the same side with respect to the web being unwound from the first web roll (roll A). The web is fed continuously in this manner. So the present method is suited for high-quality web feeding.

The present invention comprises:

an automatic web splicing apparatus, a roll rocking apparatus for rocking two mounted web rolls, and an rock driving apparatus for rocking the arm of the aforementioned roll rocking apparatus, and a control apparatus which provides control in such a way that, when the web being fed has been switched by the aforementioned automatic web splicing apparatus so as to be fed from another web roll, a new web roll is mounted on one end of the arms, then the one web roll mounted on the aforementioned roll rocking apparatus is shifted to the side opposite to the running web face and is mounted in position, subsequent to the removal of the web core remaining on the one end of the arm; and when the web being fed from the another web roll is switched by the aforementioned automatic web splicing apparatus so as to be fed from a next web roll and the next new web roll is mounted on the other end of the arms, then the aforementioned web roll is mounted on the same side with respect to the front and back sides of the running web, subsequent to removal of the web core remaining on the other end of the arms.

As described above, the web feed apparatus according to the present invention comprises:

an automatic web splicing apparatus, a roll rocking apparatus for rocking at least two mounted web rolls, a rock driving apparatus for rocking the arm of the aforementioned roll rocking apparatus, and a control apparatus which provides control in such a way that, when the web being fed has been switched by the aforementioned automatic web splicing apparatus so as to be fed from another web roll, a new web roll is mounted on one end of the arms, then one web roll mounted on the aforementioned roll rocking apparatus is shifted onto the opposite side with respect to the front and back side of the running web and is mounted in position, subsequent to removal of the web core remaining on one end of the arm; and when the web being fed from another web roll is switched by the aforementioned automatic web splicing apparatus so as to be fed from a next web roll and the next new web roll is mounted on the other end of the arm, then the next new web roll is mounted on the same side with respect to the front and back sides of the running web face, subsequent to removal of the web core remaining on the other end of the arm. These arrangements make it possible to eliminate the need of using a slip ring and rotary joint required in a prior art apparatus, and provide a simple structure, easy and less costly maintenance control, and a reduced installation space.

BRIEF DESCRIPTION OF THE DRAWINGS

FIG. 3(*b*) is a detailed view of portion P in FIG. 3(*a*);

FIG. 10(*b*) is an enlarged view representing portion Q in FIG. 10(*a*);

FIG. 13(*b*) is a schematic explanatory diagram representing the status at the time of switching to a new web roll in FIG. 13(*a*);

FIGS. 14(*a*) to 14(*d*) show a web splicing procedure;

FIG. 16(*a*) shows the case where electric power is supplied;

FIG. 16(*b*) shows the case where fluid such as compressed air or water is fed;

FIG. 17(*a*) is a plan view thereof;

FIG. 17(*b*) is a front view thereof;

FIG. 18(*a*) shows the state of a web being unwound from a web roll; and

FIG. 18(*b*) shows how the remaining web core is removed and a new web roll is installed.

DETAILED DESCRIPTION OF PREFERRED EMBODIMENTS

Figure 1:
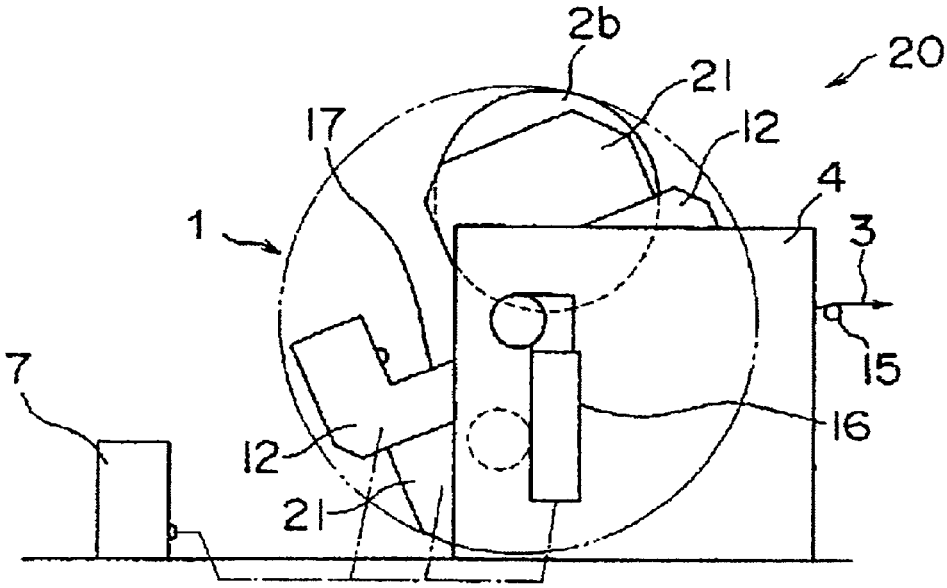
FIG. 1 is a side view representing the outside shape of a continuous web feed apparatus according to the first embodiment of the present invention.
Figure 2:
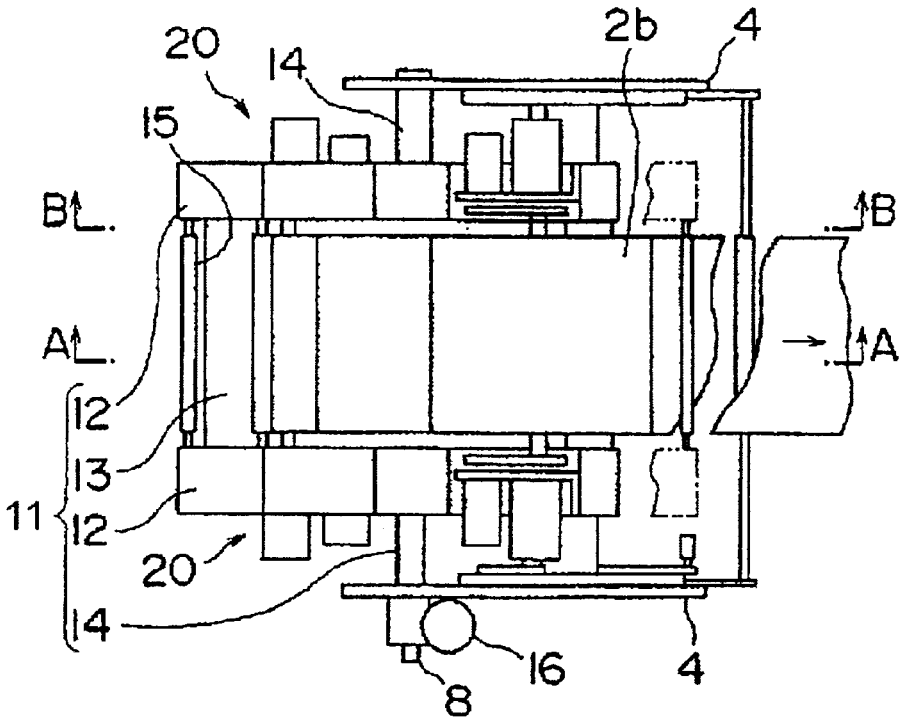
FIG. 2 is a plan view representing a continuous web feed apparatus according to the first embodiment of the present invention.
Figure 3A:
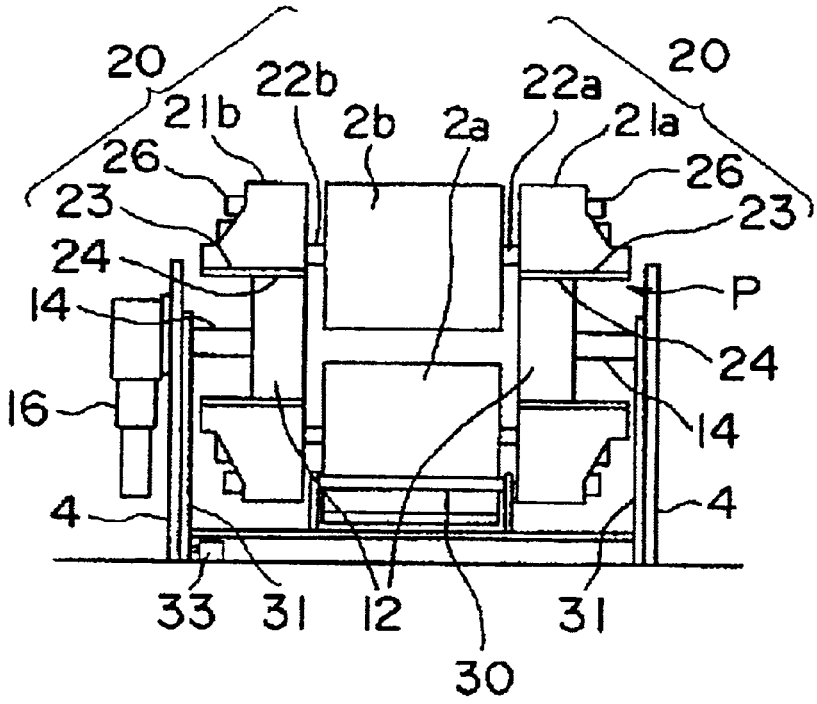
FIG. 3(*a*) is a plan view representing a continuous web feed apparatus according to the first embodiment of the present invention.
Figure 3B:
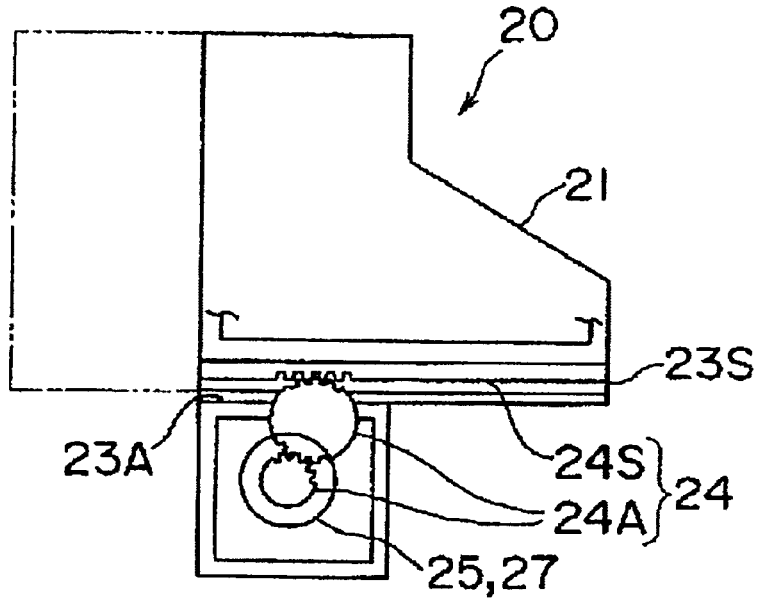
Figure 4:
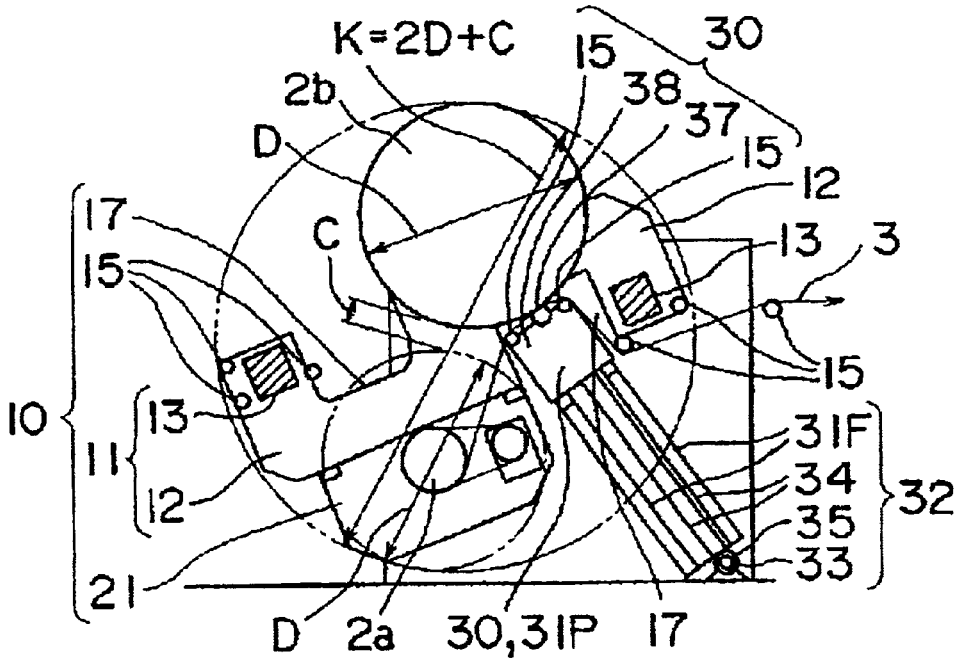
FIG. 4 is a cross sectional view taken along A—A in FIG. 2.
Figure 5:
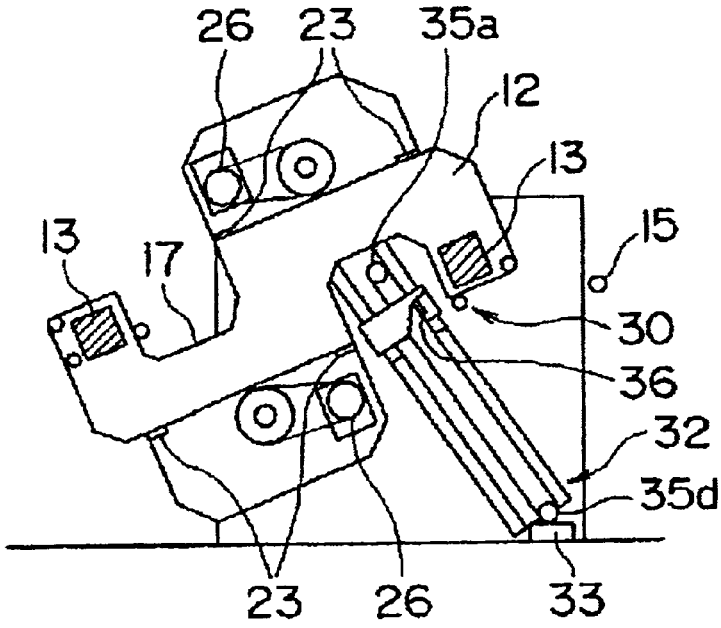
FIG. 5 is a cross sectional view taken along B—B in FIG. 2.
Figures 6A, 6B, 6C, 6D, 6E, 6F, 6G, 6H:
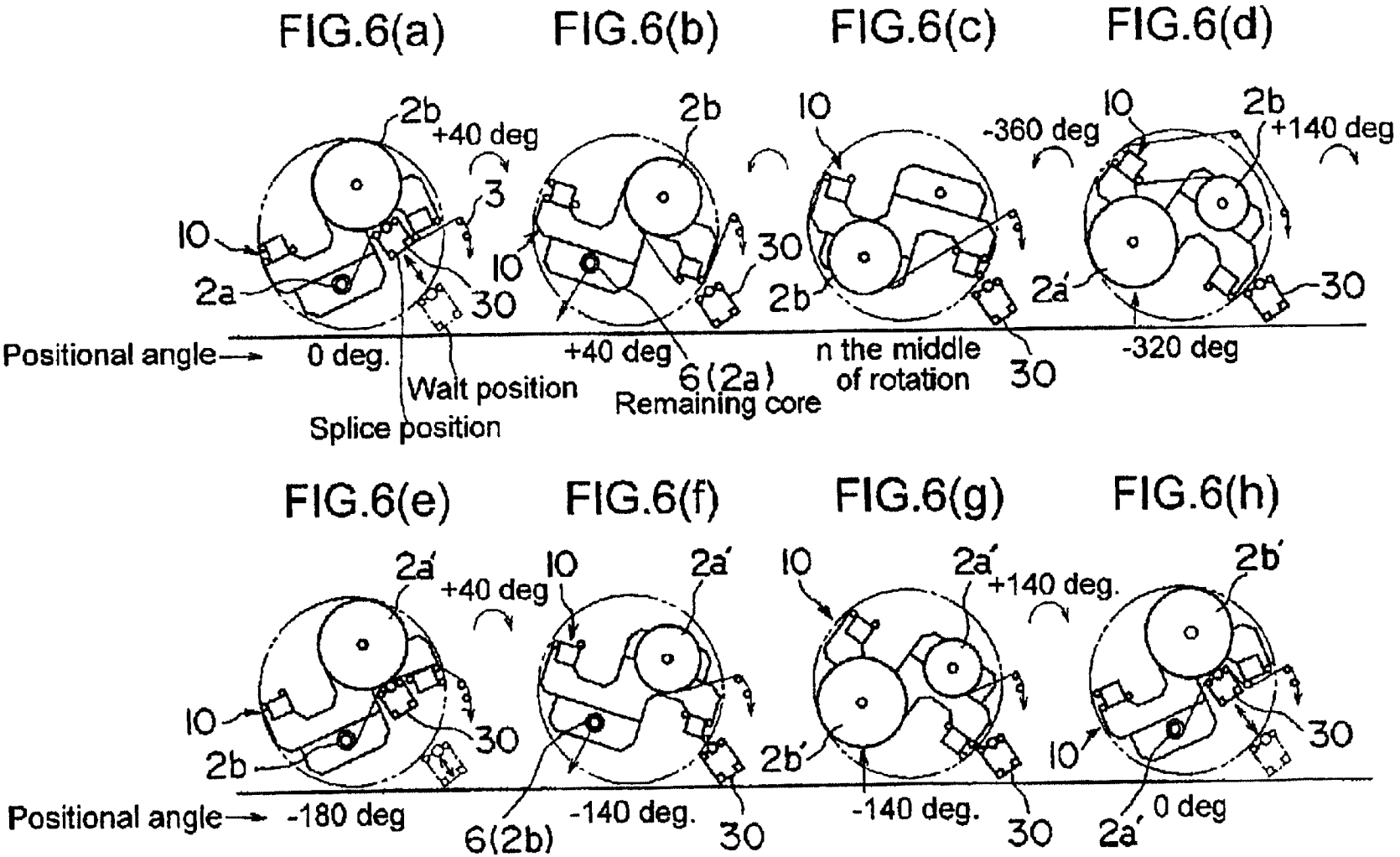
FIGS. 6(*a*) to 6(*h*) are schematic drawings representing the automatic web splicing operation of a continuous web feed apparatus according to the first embodiment of the present invention.
Figure 7:
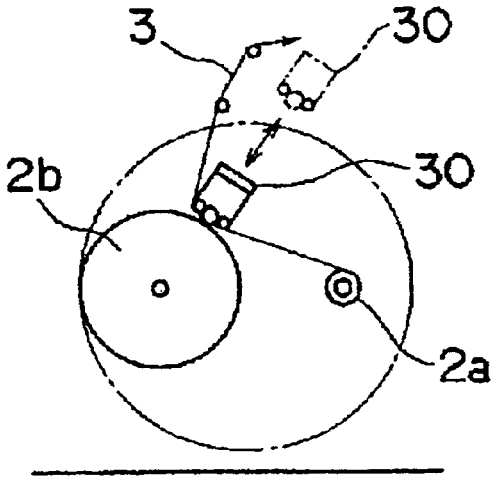
FIG. 7 is a schematic drawing representing the example of the automatic web splicing apparatus of a continuous web feed apparatus installed on the top according to the first embodiment of the present invention.

The details of the present invention with reference to the illustrated embodiment will be described in the following. FIG. 1 is a side view representing the outside shape of the continuous web feed apparatus according to a first embodiment of the present invention. FIG. 2 is a plan view and FIG. 3 is a front view. FIG. 4 is a cross sectional view taken along A—A in FIG. 2. FIG. 5 is a cross sectional view taken along B—B in FIG. 2. FIG. 6 is a schematic drawing representing the automatic web splicing operation. FIG. 7 is a schematic drawing representing the example of the automatic web splicing apparatus installed on the top.

Unless otherwise specified, the dimensions, material, configurations and relative positions of the components described in the continuous web feed apparatus according to the first embodiment of the present invention are not restricted to specifics that will be mentioned below. The following discussions are given only as examples for the sake of illustration. The same portions as the aforementioned conventional examples will be assigned with the same reference numerals, and duplicated descriptions will be omitted.

In FIGS. 1 to 5, the continuous web feed apparatus 1 comprises a web roll 2 for feeding the web 3 and a roll support apparatus 20 provided on the opposite sides across the width of this web roll 2, the aforementioned roll support apparatus 20 being capable of mounting or removing the core of the web roll 2 and moving the web roll 2 in the axial direction. The web roll 2 comprises a web roll 2*a* in the process of unwinding the web 3 and a new web roll 2*b* ready to be spliced with to the tip of the web 3.

Arms 12 supporting two roll support apparatuses 20 are provided on opposite sides across the width of the web roll 2. These arms 12 have a block shape, and are shaped approximately in the shape of letter S, when viewed from the side, with concave portions 17 provided on the upper and lower surfaces at opposite positions. These arms are rockably (or rotatably) configured. Thus, the arms 12 on the opposite sides of the web roll 2 are fixed in position by a beam 13 and are connected with each other. Support shafts 14 are provided outside the rocking centers in the width direction. Accordingly, the roll support frame 11 is composed of arms 12, beams 13 and support shafts 14. The support shafts 14 of the roll 15, support frame 11 are supported by bearings (not illustrated) on frames 4 installed on opposite sides in the axial direction.

On the shaft end of one of the aforementioned support shafts 14 on both sides, a rocking drive apparatus 16 for rocking the support shaft 14 is mounted on the frame 4, and a rocking position detector 8 for detecting the rocking position of the roll support frame 11 is installed on the end of this support shaft 14 so as to be engaged therewith. Further, a control apparatus 7 for controlling various operations is provided at the position associated with the continuous web feed apparatus 1 and carries out controlling functions based on signals from the rotating position detector 8 and signals responsive to the conditions of the continuous web feed apparatus 1.

Multiple guide rollers 15 for guiding the web 3 unwound from the web roll 2 are provided around the beam 13.

Relationship between the arm 12 of the aforementioned roll support frame 11 and the roll support apparatus 20 is configured in such a way that the roll support apparatus 20 can be moved in the axial direction of the web roll 2 by the guide 23 (guide 23A on the arm 12 and guide 23S on the roll support apparatus 20 side are engaged for guiding) provided in the axial direction of the web roll 2, on the support portion of the web rolls 2 of the arms 12 on both sides across the width.

Chucks 22*a* and 22*b* for mounting the core of the web roll are rotatably supported on the roll support apparatus 20. Moreover, the roll support apparatus 20 is configured in such a way that a brake for applying an appropriate tension can be applied to it at the time of unwinding the web 3, and it can be driven by a roll drive control motor 26 for accelerating the web roll 2 at the time of splicing. The aforementioned roll support apparatus comprises a support block 21 for supporting them and a traveling mechanism 24 for moving the aforementioned support block 21 along the guide 23. This traveling mechanism 24 comprises a rack 24S on the support block, and a pinion 24A, traveling motor 25 and position detector 27 on the arm 12 side. The aforementioned support block 21 is configured in such a way as to synchronize the support blocks 21*a* and 21*b* on both sides with each other and to shift the position thereof in the axial direction or separately.

The continuous web feed apparatus 1 according to the first embodiment is arranged in such a way that a new web roll 2*b* mounted at the specific rocking position (FIG. 6(*a*) or 6(*e*)) of the roll rocking apparatus 10 including the roll support apparatus 20 supporting the web roll 2 and the roll support frame 11 supporting them can be spliced with running web 3 by the automatic web splicing apparatus 30, and can feed the web 3 continuously.

This automatic web splicing apparatus 30 makes an approach so as to splice the web 3 to the new web roll 2*b* at the aforementioned specific position, and performs its operation at the splicing position indicated by a solid line in this drawing. When the roll rocking apparatus 10 holding the web roll 2 performs the rocking operation, it is arranged to wait at the waiting position out of the relevant range as indicated by a dotted line in the drawing. Further, a guide 31 and a traveling apparatus 32 are provided inside the frame 4 so that the automatic web splicing apparatus 30 can be moved to the waiting position and the web splicing position by the aforementioned traveling apparatus 32.

As described above, to ensure that the roll rocking apparatus 10 allows the web 3 to be spliced by the automatic web splicing apparatus 30 at a specific position, the aforementioned concave portions 17 are provided on the upper and lower surfaces of the arm 12. They are intended to make new web rolls 2*b* and 2*a*' approachable even if these web rolls 2*b* and 2*a*' have a small diameter.

In the traveling apparatus 32 of the automatic web splicing apparatus 30, a guide 31F mounted on the frame 4 side and a guide 31P mounted on the side of the automatic web splicing apparatus 30 are engaged with each other, and pulleys 35*a* and 35*d* are installed at predetermined intervals so that a toothed endless belt 34 will run along the guide 31. The pulley 35*d* is installed on the shaft end of the traveling motor 33 which drives the toothed endless belt 34. Moreover, part of toothed endless belt 34 is fixed to the automatic web splicing apparatus 30 by means of a fixture 36, and the automatic web splicing apparatus 30 can be moved along the guide 31 by this endless belt 34.

To illustrate a variation of the above-mentioned first embodiment, FIG. 7 shows the automatic web splicing apparatus 30 provided above the web roll 2. This example shows that the position of configuration can be changed freely.

The automatic web splicing apparatus 30 of the first embodiment has been described to travel along the guide 31. However, this does not depend on a particular traveling mechanism; for example, an arrangement can be made so that it is moved to the splice position and the waiting position by the rocking arm.

Referring now to FIGS. 1 to 6, especially to FIG. 6, the operation and effect of the web feed method and continuous web feed apparatus 1 according to the first embodiment of the present invention are described in the following:

The roll rocking apparatus 10 wherein two web rolls 2*a* and 2*b* are held above the roll support frame 11 by means of the roll support apparatus 20 is rocked about the support shaft 14 by the rocking drive apparatus 16. In response to various states based on the signals from the rotating position detector 8 engaged with the end of the support shaft 14, a control apparatus 7 controls the splicing of web 3, collection of the remaining core 6, mounting of the new web roll 2 and rocking of the roll rocking apparatus 10.

FIG. 6(*a*) shows the state of web connections for switching the web 3. This state shown in FIG. 6(*a*) is assumed as an origin (0 degree) of the rocking position angle of the roll rocking apparatus 10, and various states and rocking angles are represented in the subsequent figures.

As shown in FIG. 6(*a*), when the web roll 2*a* unwinding the web 3 has been reduced in diameter to come in contact with the surface of the web roll 2*b*, the automatic web splicing apparatus 30 located at the wait position is moved along the guide 31 mounted on the frame 4 by the traveling apparatus 32, and waits at the splice position. Then the speed of the new web roll 2*b* is increased by a roll drive control motor 26 through a core chuck 22. When the same surface speed has been reached between the running web 3 and web roll 2*b*, the pressing apparatus 37 of the splicing apparatus 30 is pushed out at timed intervals so that the running web 3 is pressed against the new web roll 2*b*. Then the running web 3 is brought into contact with a pasted portion prepared on the tip of the web on the surface of the new web roll 2*b*, and the web 3 unwound from the web roll 2*a* is cut off by the saw blade 38, and the web 3 is fed from the new web roll 2*b*.

In this case, even when the new web roll 2*b* has a small diameter, approach is permitted due to the presence of the arm concave 17 of arm 12 supporting the web roll 2 when the automatic web splicing apparatus 30 is located at the splice position. This makes it possible to handle a small-diameter web roll 2*b* wherein reduction in roll diameter often occurs upon termination of printing during use. The web 3 is guided by guide rollers 15 mounted on the automatic web splicing apparatus 30 and guide rollers 15 mounted around the beam 13 of roll support frame 11. It is further supplied while being led to the guide roller 15 to be supplied. Upon splicing of the web 3, the automatic web splicing apparatus 30 retracts from the splice position to the wait position where it waits for the next operation.

In order to reach the state shown in FIG. 6(*b*), the roll rocking apparatus 10 is rocked by +40 degrees (40 degrees in the clockwise direction) by the rocking drive apparatus 16. In this state, chucks 22*a* and 22*b* on the remaining core 6 side are retracted (extended to both sides) to remove the remaining core 6, and the remaining core 6 is discharged by a core collecting apparatus (not illustrated) and the like.

In order to reach the state of FIG. 6(*d*) while passing through the state shown in FIG. 6(*c*), the roll rocking apparatus 10 is rocked by −360 degrees (360 degrees in the counterclockwise direction) to be located at the −320-degree position. In this state, a loading apparatus (not illustrated) is used to carry a new web roll 2*a*' into the portion where the remaining core 6 has been removed. The traveling motor 25 is driven to move the roll support apparatus 20 in the axial direction, and the web roll 2*a*' is held by chucks 22*a* and 22*b*. Namely, the web roll 2*a*' is mounted in the state shown in FIG. 6(*d*) after the above-mentioned chuck 22 has passed the web 3 unwound from the web roll 2*b* subsequent to removal of the web roll 2*a* (the remaining core 6). (Before the state of FIG. 6(*c*) is reached from the state of FIG. 6(*b*), the empty chuck is rocked beyond the running web 3.)

The web end of the new web roll 2*a*' is mounted after preparations for splicing such as pasting have been completed.

This is followed by the step of turning the roll rocking apparatus 10 by +140 degrees (140 degrees in the clockwise direction) to reach the position of −180 degrees shown in FIG. 6(*e*). If there is no more web remaining on the web roll 2*b* at this position, the web 3 unwound from the web roll 2*b* is spliced to the new web roll 2*a*' by the automatic web splicing apparatus 30 and a switching operation is performed, similarly to the case of FIG. 6(*a*). After that, the roll rocking apparatus 10 is turned +40 degrees (40 degrees in the clockwise direction) to reach the position of −140 degrees (FIG. 6(*f*)). Then the remaining web roll 2*b* (the remaining core 6) is removed.

Then the new web roll 2*b*' is mounted at the same position. As shown in FIG. 6(*g*), the roll rocking apparatus 10 is turned +140 degrees (140 degrees in the clockwise direction) to get the 0-degree position (FIG. 6(*h*)), namely, the same phase as that of FIG. 6(*a*), and the web roll is switched from 2*a*' to 2*b*' by the automatic web splicing apparatus 30. The above procedure is repeated to feed the web 3 on a continuous basis.

What is noteworthy in this respect is as follows: In the step of switching the web roll 2, when the new web roll 2*a*' on the side of web roll 2*a* is installed subsequent to switching of the web roll 2*a* over to 2*b*, the arm 12 is rocked subsequent to removal of the remaining core of the web roll 2*a* so that the chuck 22 of the relevant portion passes the running web 3. Then the new web roll 2*a*' is mounted in position (from FIG. 6(*b*) to FIG. 6(*d*)). In the step of switching from the web roll 2*b* to the new web roll 2*a*', however, the next web roll 2*b*' is mounted on the side where the remaining core 6 of the web roll 2*b* has been removed (FIG. 6(*f*) to FIG. 6(*g*)).

The above explains the major reason why the surfaces (front and back) of the web 3 being fed on a continuous basis can be kept unchanged at all times, despite the rocking type configuration.

The continuous web feed apparatus 1 according to the first embodiment of the present invention is configured as described above, and hence the following various effects can be realized by the operation of this apparatus:

(1) The web 3 is fed on a continuous basis by rocking (not rotating) of the web roll rocking apparatus 10. This eliminates the need of mounting a slip ring, rotary joint or the like on the support shaft 14 of the roll rocking apparatus 10, thereby reducing the dimensions across the width. Further, electric components of weak current or large current can be reduced in the web roll rocking apparatus 10, with the result that high-performance can be ensured. There are additional advantages of ensuring easy maintenance and reduced maintenance costs. Further, there is no leakage loss even if compressed air or the like is used, and no power loss due to drive resistance attributable to leakage preventive sealing material.

(2) The front and back of the web 3 can be kept unchanged at all times, so this apparatus can be used as a high-quality web feed apparatus.

(3) Support shafts 14 as a rocking center of roll rocking apparatus 10 are provided on both the outer sides of arms 12 on both sides across the width, and there is no central portion across the width. When the web roll 2 is installed, the rocking diameter K is as small as 2D+C, with the result that the installation space is reduced.

(4) The arm 12 of the roll rocking apparatus 10 comprises arm concaves 17 provided in response to the positions where automatic web splicing apparatus 30 operates, and this reduces the distance of approach to new web rolls 2*a*' and 2*b*' at the splice position. The apparatus can be applied to new web rolls 2*a*' and 2*b*' having a smaller diameter web roll, thereby increasing the range of use.

The automatic web splicing apparatus 30 of FIG. 7 mounted on the top can be selected with consideration given to the cases where there is no space on the bottom but there is a space on the top, or ease of doing work on the bottom is essential.

Figures 8A, 8B, 8C, 8D, 8E, 8F, 8G, 8H:
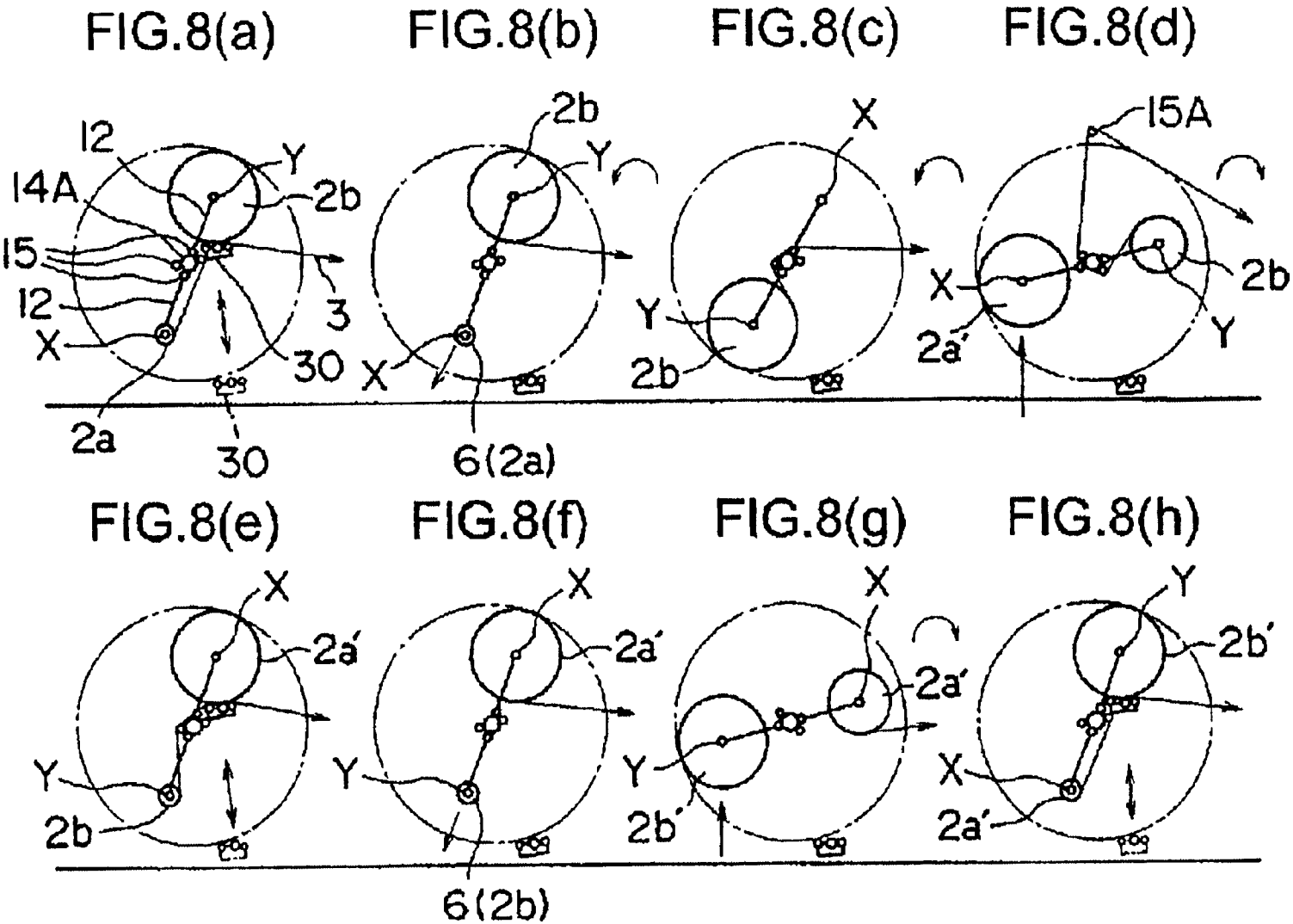
FIGS. 8(*a*) to 8(*h*) are schematic drawings representing the automatic web splicing operation of a continuous web feed apparatus according to the second embodiment of the present invention.

FIG. 8 is a schematic drawing representing a continuous web feed apparatus according to the second embodiment of the present invention. It shows automatic web splicing operation.

The main differences of the continuous web feed apparatus according to the second embodiment shown in FIG. 8 from that of the aforementioned first embodiment are that the support shaft 14A penetrates across the width, and arms 12 on both sides across the width are supported by the support shaft 14A. Further, there is no beam 13 of the aforementioned first embodiment. The guide roller 15 provided around the beam 13 in the first embodiment is located around support shaft 14A in the second embodiment, and guide roller 15A is located at a specific position with respect to arm 12. The omitted portion of the structure of the continuous web feed apparatus is about the same as that described in the first embodiment shown in FIGS. 1 and 7.

Referring now to FIG. 8, the web feed cycle of the continuous web feed apparatus according to the second embodiment will be described. It should be noted that FIG. 8(*a*) corresponds to FIG. 6(*a*), and FIG. 8(*b*) corresponds to FIG. 6(*b*). Other drawings also have such correspondences, so only the major points will be described below.

In FIG. 8(*a*), supply of the web 3 is switched from the web roll 2 on the installation side X to the web roll 2*b* on the side Y, and the remaining core 6 is removed in FIG. 8(*b*). Rocking operation is performed until the state of FIG. 8(*d*) is reached through FIG. 8(*c*); then new web roll 2*a*' is mounted in position. In this state, the guide roller ISA located at a specific position with respect to arm 12 is positioned at the illustrated place, so the web 3 is arranged not to contact the web roll 2*b*. The position of the arm 12 in this state on the X-side is similar to what has been described with reference to the first embodiment; the new web roll 2*a*' is mounted at the position where the running web 3 has rocked and passed subsequent to removal of the remaining core 6.

After that, the running web 3 is again spliced to a new web roll 2*a*' in FIG. 8(*e*), and the web is continued to be fed from the web roll 2*a*'. After the remaining core 6 has been removed on the side Y in FIG. 8(*f*), a new web roll 2*b*' is mounted at the approximate position shown in FIG. 8(*g*). If there is only a small amount of web remaining on the web roll 2*a*', web 3 is switched from web roll 2*a*' to 2*b*' in FIG. 8(*b*). These steps are taken to ensure continuous feed of the web 3.

A continuous web feed apparatus according to the second embodiment of the present invention performs the operations mentioned above. Unlike the first embodiment, there is no beam 13 which would connect the webs 12 on opposite sides across the width. This arrangement gives the operator an easy access to the web feed apparatus 1, and hence an advantage of facilitating routine work, maintenance and inspection.

Figures 9A, 9B, 9C, 9D, 9E, 9F, 9G, 9H, 9I:
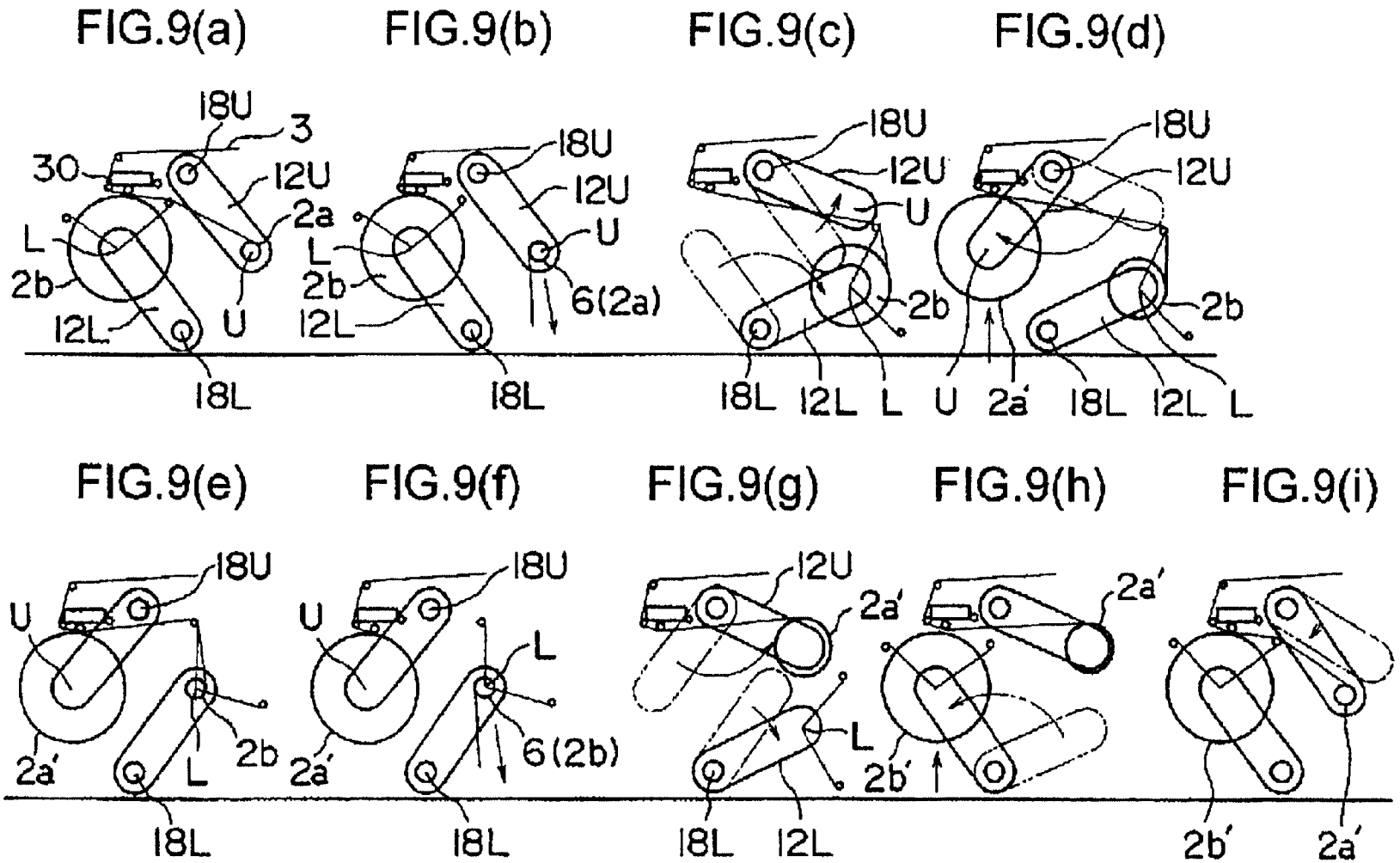
FIGS. 9(*a*) to FIG. 9(*i*) are schematic drawings representing the automatic web splicing operation of a continuous web feed apparatus according to the third embodiment of the present invention.

FIG. 9 is a schematic drawing showing the continuous web feed apparatus according to the third embodiment of the present invention. It illustrates automatic web splicing operation.

The differences of the continuous web feed apparatus of the third embodiment given in FIG. 9 from that of the aforementioned first embodiment can be described as follows: Two web rolls 2 are mounted by arms 12 on both sides across the width according to the first embodiment. In the first embodiment, arms 12U and 12L are mounted on the upper and lower portions, and two web rolls 2 are supported by the arms 12U and 12L, respectively. Arms 12U and 12L are independently rocked about support shafts 18U and 18L, respectively. Rocking drive apparatuses 16U and 16L (not illustrated) are provided on the shaft end of each of the support shafts 18U and 18L. The automatic web splicing apparatus 30 is supported by the frame 4 as in the case of the first embodiment, and is moved by the traveling apparatus.

Referring now to FIG. 9, the web feed cycle of the continuous web feed apparatus according to the third embodiment will be described below. In FIG. 9(*a*), the feeding of web 3 is changed from the web roll 2*a* on the side U to the web roll 2*b* on the side L by the automatic web splicing apparatus 30, and the remaining core 6 is removed, as shown in FIG. 9(*b*). Then the arm 12U is rocked in advance in the counterclockwise direction as shown in FIG. 9(*c*), whereby it is retracted to the position where the arm 12L can be rocked. In this state, the arm 12L is rocked in the clockwise direction. Then the arm 12U is rocked to the position shown in FIG. 9(*d*) and a new web roll 2*a*' is mounted in position. When the apparatus is in this position, the new web roll 2*a*' is mounted at the position where the running web 3 has been passed after the remaining core 6 has been removed, similarly to what is described with reference to the aforementioned first embodiment.

In FIG. 9(*e*), the running web 3 is again spliced to the new web roll 2*a*', and the web is continued to be fed. After the remaining core 6 on the side L has been removed in FIG. 9(*f*), the arm 12L is in advance rocked in the clockwise direction and is retracted in FIG. 9(*g*). Then the arm 12U is rocked in the counterclockwise direction to reach the illustrated position to prepare for the next step. In FIG. 9(*h*), the arm 12L is rocked in the counterclockwise direction, and the new web roll 2*b*' is mounted on the side L at the illustrated position. In this case, installation of new web roll 2*b*' subsequent to the removal of the remaining core 6 (web roll 2*b*) is carried out on the same side for the web 3. FIG. 19(*l*) shows the case where there is a decrease in the amount of the remaining web on the web roll 2*a*' so that the web is switched over to the web roll 2*b*', similarly to the case of FIG. 9(*a*). These steps are taken to sure that web 3 is fed continuously.

The continuous web feed apparatus according to the third embodiment of the present invention operates as follows: Unlike the first embodiment, two web rolls 2 are supported by arms 12U and 12L, respectively. Since arms 12U and 12L do not require rocking angles ranging up to 360 degrees, the height can be made smaller than the aforementioned first or second embodiment. This provides an advantage of saving space.

Figure 10A:
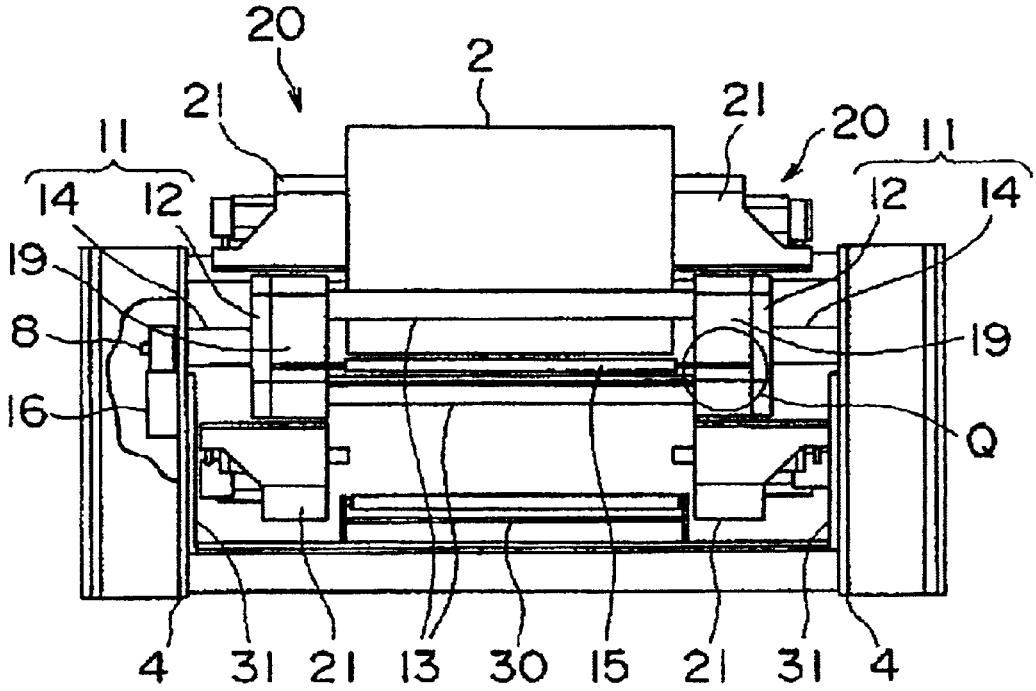
FIG. 10(*a*) is a front view representing how a full-width web roll is installed on a continuous web feed apparatus according to the fourth embodiment of the present invention.
Figure 10B:
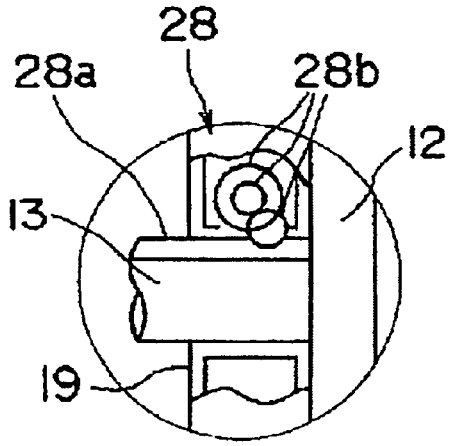
Figure 11:
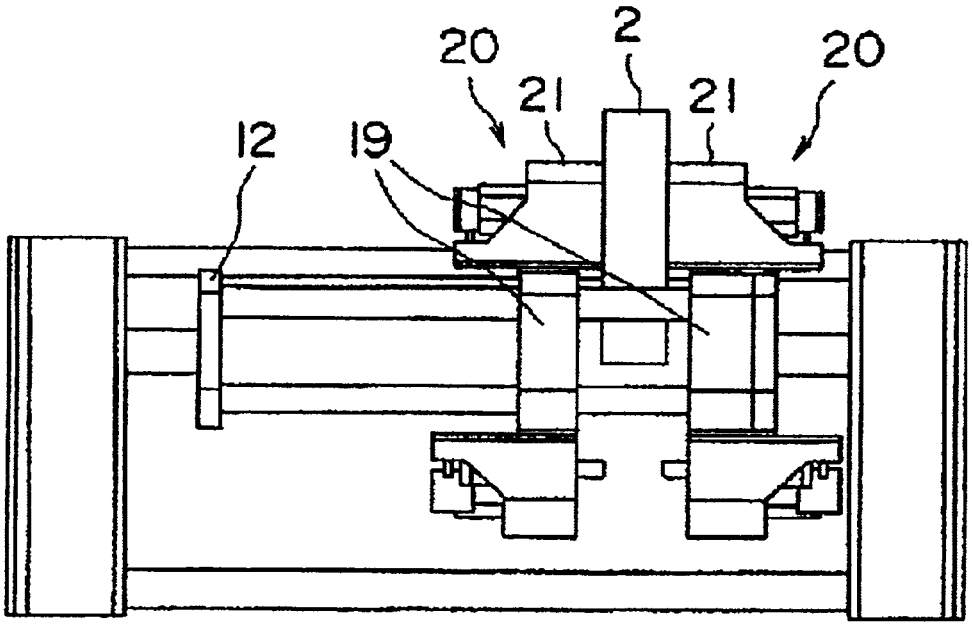
FIG. 11 is a front view representing an example of the state of the small-width web roll pulled over to on one side and mounted in a continuous web feed apparatus according to the fourth embodiment of the present invention.
Figure 12:
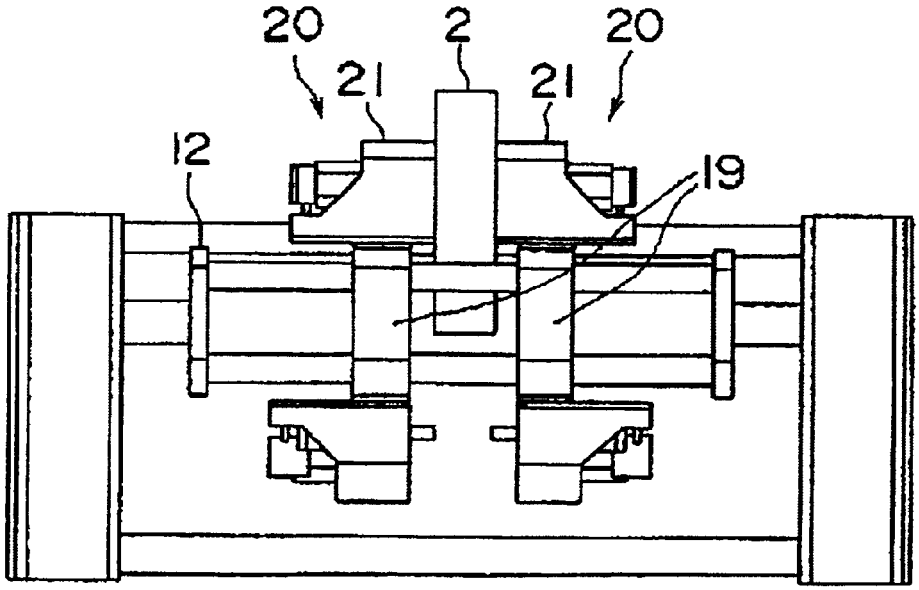
FIG. 12 is a front view representing an example how a small-width web roll is installed at the center in a continuous web feed apparatus according to the fourth embodiment of the present invention.
Figure 13A:
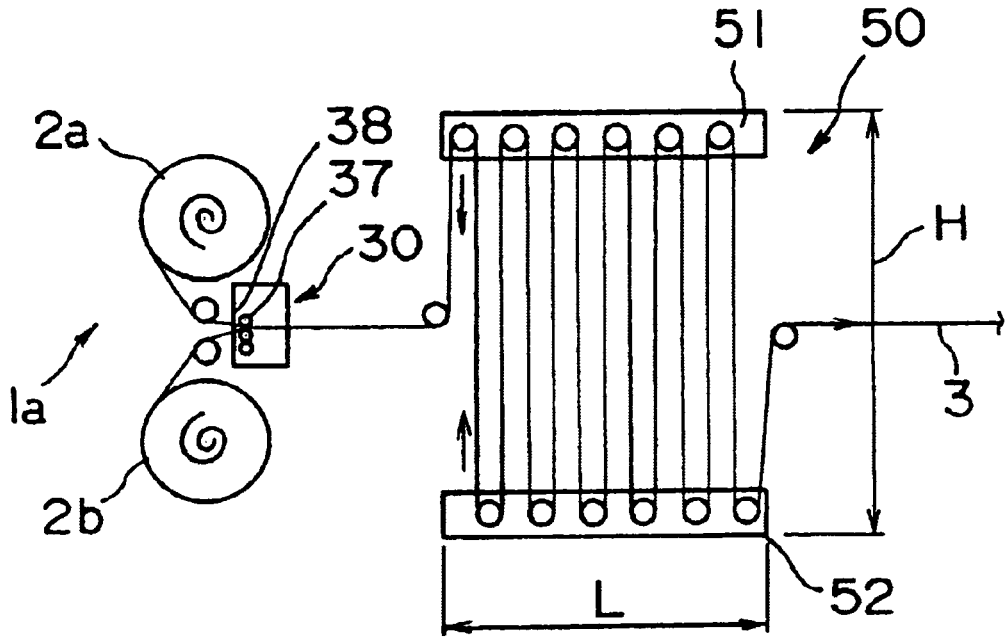
FIG.13(a) PRIOR ART
FIG. 13(*a*) is a schematic explanatory diagram representing a prior art continuous web feed apparatus for splicing a web at zero speed.
Figure 13B:
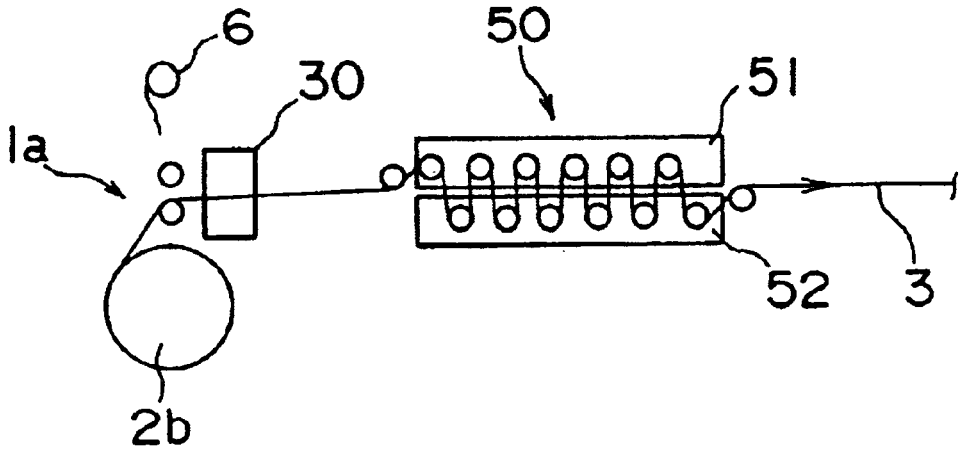
FIG.13(b) PRIOR ART
Figure 14A:
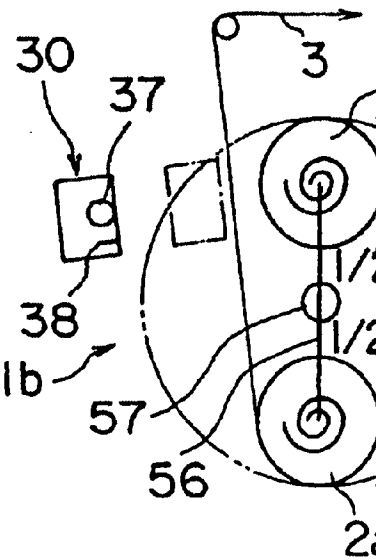
FIG.14(a) PRIOR ART
FIG. 14 is a schematic explanatory diagram representing a prior art continuous web feed apparatus for splicing a web while running.
Figure 14B:
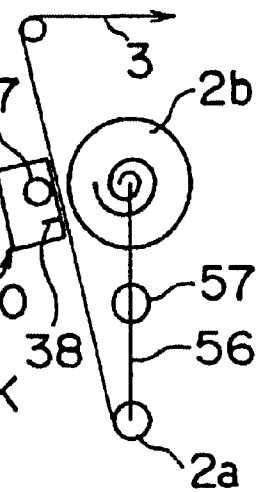
FIG.14(b) PRIOR ART
Figure 14C:
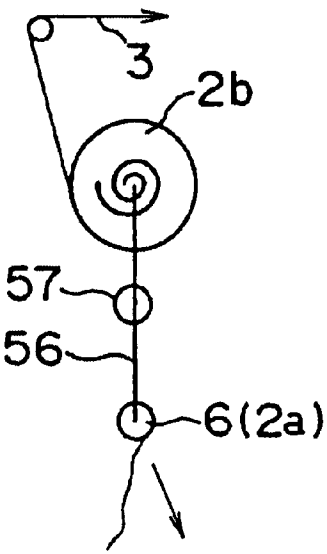
FIG.14(c) PRIOR ART
Figure 14D:
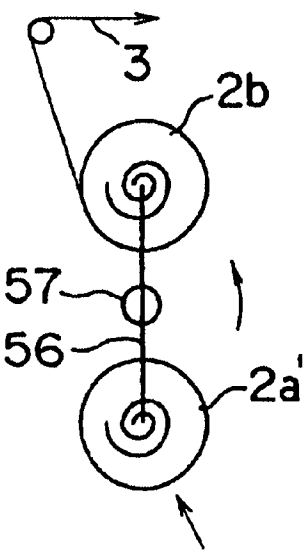
FIG.14(d) PRIOR ART
Figure 15:
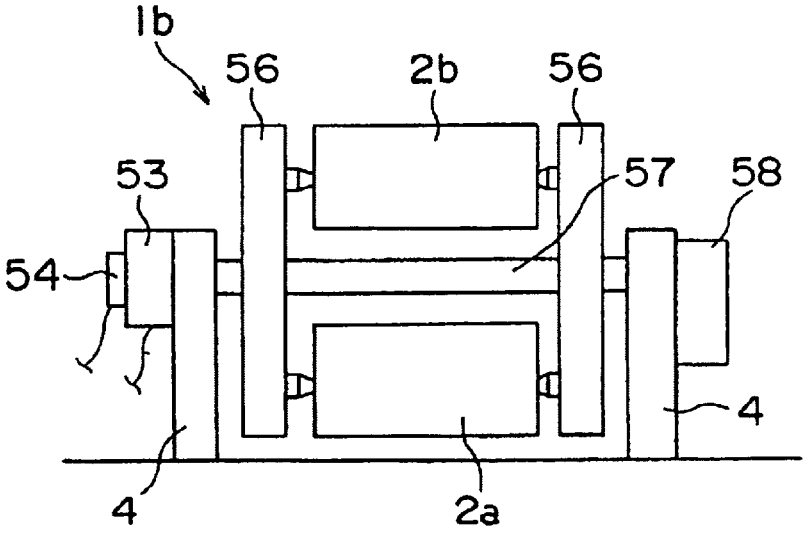
FIG.15 PRIOR ART
FIG. 15 is a front view representing a prior art continuous web feed apparatus in FIG. 14.
Figure 16A:
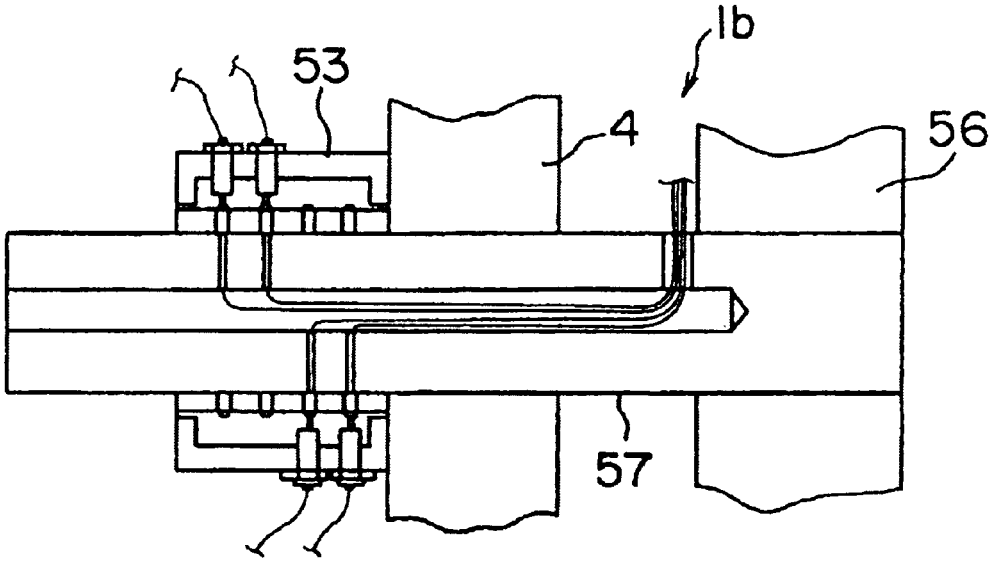
FIG.16(a) PRIOR ART
FIG. 16 is a schematic explanatory diagram representing the end of the support shaft mounted on a prior art continuous web feed apparatus using the rotating arm.
Figure 16B:
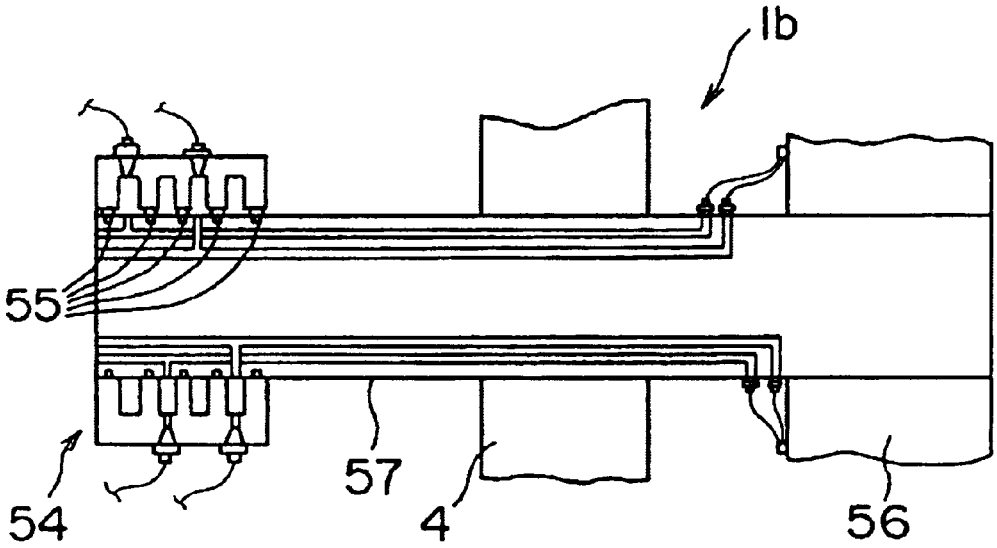
FIG.16(b) PRIOR ART
Figure 17B:
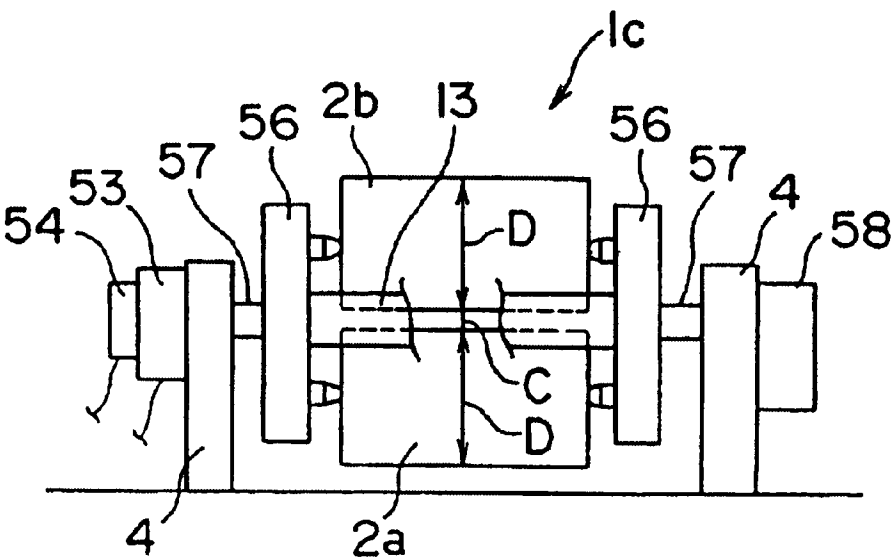
FIG.17(b) PRIOR ART
FIG. 17 is a schematic explanatory diagram representing a prior art continuous web feed apparatus with a support shaft penetrating across the width wherein running webs are spliced.
Figure 17A:
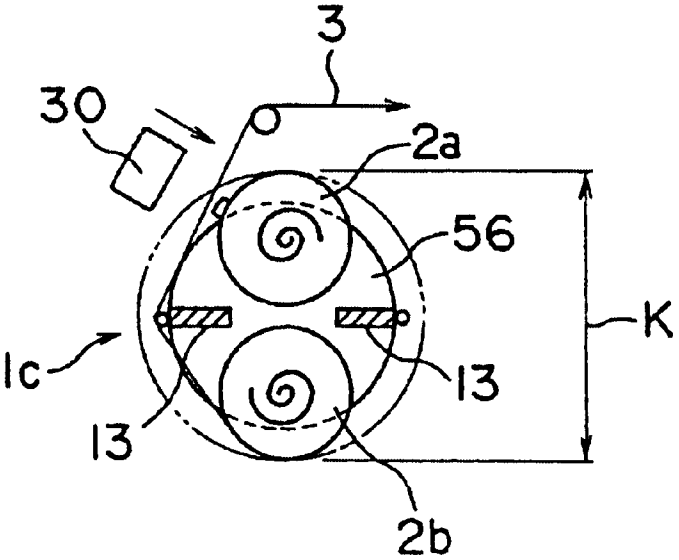
FIG.17(a) PRIOR ART
Figure 18B:
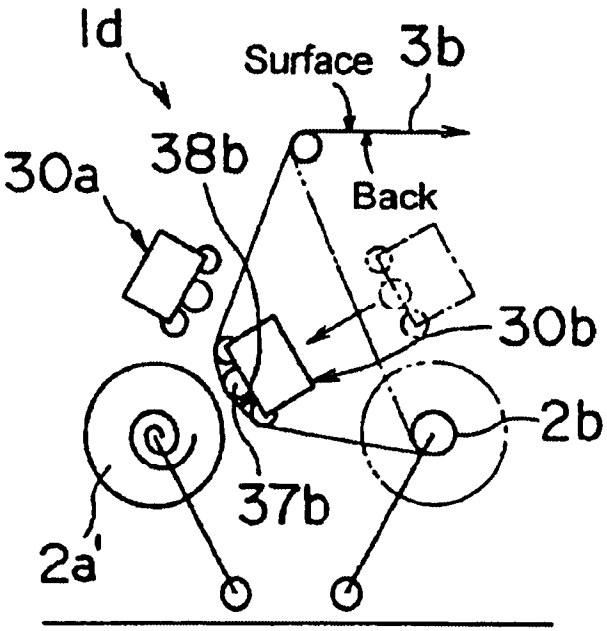
FIG.18(b) PRIOR ART
FIG. 18 is a schematic explanatory diagram representing a prior art web continuous feed apparatus for continuous feeding of a web by rocking.
Figure 18A:
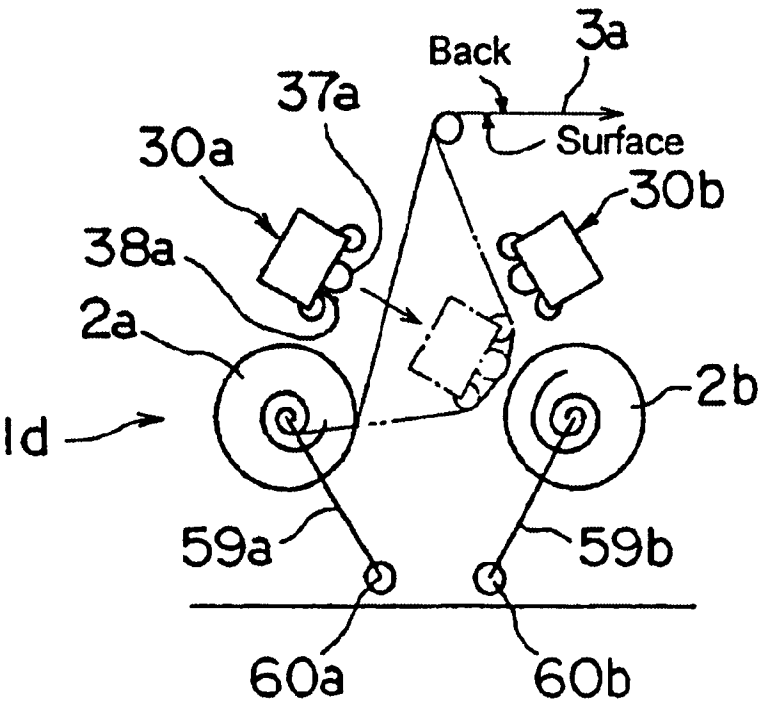
FIG.18(a) PRIOR ART

FIGS. 10 to 12 are schematic drawings showing the continuous web feed apparatus according to the fourth embodiment, and illustrate how web rolls of various widths are installed.

Differences of the continuous web feed apparatus according to the fourth embodiment shown in FIGS. 10 to 12 from that of the aforementioned first embodiment can be described as follows: The roll support frame 11 of the roll rocking apparatus 10 of the first embodiment is fixed across the width, and arm 12 as a constituent member is also fixed across the width. In the fourth embodiment given in FIGS. 10 to 12, stationary arms 12 integral with the roll support frame 11, beams 13 fixed on the stationary arms 12 on both sides and a traveling arm 19 moving across the width with the beam 13 as a guide are provided on both sides across the width. The roll support apparatus 20 is installed on the traveling arm 19.

FIGS. 10(*a*) and (*b*) show the state of full-width web roll 2 mounted in position. FIG. 11 shows the state of small-width web roll 2 pulled over to one end and mounted in position. FIG. 12 shows the state of small-width web roll 2 installed at the central position. The cross section is the same as that of the aforementioned first embodiment, and will not be described.

In the continuous web feed apparatus of the fourth embodiment, the beam 13 is fixed onto the arm 12 of the roll support frame 11, and the guide roller 15 is supported by the arm 12 of the roll support frame 11 so as to conform to full-width web 3. The automatic web splicing apparatus 30 is also configured to conform to the full-width web 3, and performs operation guided by the guide 31 installed on the frame 4, as in the case of the first embodiment. A rack 28*a* constituting an arm traveling mechanism 28 is mounted on the beam 13, and a pinion 28*b* constituting the arm traveling mechanism 28 is installed on the traveling arm 19. The arm traveling mechanism 28 is moved by the traveling motor. Moreover, an arm position detector (not illustrated) is also mounted on the arm traveling mechanism 28 to provide position control.

The continuous web feed apparatus according to the fourth embodiment of the present invention is configured as stated above. Since webs 3 of various widths can be mounted at desired positions, this apparatus can also be used in cases where the width of the web 3 or the running position of the web 3 varies over a substantial range. Thus, this apparatus is characterized by excellent versatility, in addition to the advantages of the aforementioned first embodiment.

The embodiments of the present invention have been described above. However, the present invention is not restricted to the aforementioned embodiments. Various variations and modifications are possible based on the technological concept of the present invention.

What is claimed is:

1. A web feed method in which an apparatus for holding two web rolls and unwinding a web continuously by means of an automatic web splicing apparatus is used, said method comprising the steps of:

switching unwinding of the web from one web roll to the other web roll;

rocking an arm supporting said one web roll to a position in which a remaining core is removed;

removing the remaining core from the arm supporting said one web roll;

moving an installation position of said one web roll to an opposite or reverse side with respect to the front and back sides of the web which is being unwound from the other web roll;

switching the unwinding of the web from said other web roll to said one web roll;

removing the remaining core of said other web roll subsequent to switching;

mounting a new web roll on a same side with respect to the front and back side of the web which is being unwound from said one web roll in an installation position of said other web roll.

2. A web feed apparatus comprising:

an automatic web splicing apparatus;

a roll rocking apparatus, including a one roll rocking apparatus and an other roll rocking apparatus, for rocking two mounted web rolls;

a rock driving apparatus for rocking an arm of the roll rocking apparatus; and a control apparatus which provides control in such a way that, when a web that is being fed from one web roll that is mounted on said roll rocking apparatus has been switched by the automatic web splicing apparatus so as to come from the other web roll, a new web roll is mounted on the roll rocking apparatus after the roll rocking apparatus is shifted to a side opposite with respect to a running web, subsequent to removal of the remaining core of said one roll rocking apparatus; and when a web that is being fed from the other web roll has been switched by the automatic web splicing apparatus so as to come from said one web roll, the new web roll is mounted on the same side with respect to the running web, subsequent to removal of the remaining core of said other roll rocking apparatus.

3. The web feed apparatus according to claim 2, wherein the roll rocking apparatus comprises:

arms for supporting two web rolls wherein the arms are installed on opposite sides across the width of the web roll, beams for securing the arms together, a support shaft provided at a position for rocking two web rolls on the arms so as to allow alternate use of the web rolls, an arm side guide installed on a web roll support of the arms so that the arm side guide moves in a direction of each web roll axis, and a roll support apparatus which moves as engaged with the arm side guide for mounting, dismounting and positioning the web roll.

4. The web feed apparatus according to claim 2, wherein the roll rocking apparatus comprises:

arms for supporting two web rolls installed on opposite sides across the width of a web roll, a beam for securing the arms together, a support shaft provided at a position for rocking two web rolls on the arms so as to allow alternate use of the web rolls, traveling arms capable of moving in an axial direction of web rolls guided by the beam, wherein said traveling arms are mounted on opposite sides across the width of the web roll, an arm traveling mechanism arranged to move the traveling arms in the axial direction with respect to said beam, a traveling arm side guide installed on the web roll support of the arms so as to allow movement in the axial direction of each web roll, and a roll support apparatus which can move in engagement with the traveling arm side guide for mounting, dismounting and positioning the web roll.

5. The web feed apparatus according to claim 2, wherein the roll rocking apparatus comprises two pairs of arms for supporting one web roll, wherein the arms are installed on opposite sides across a width of the web roll, and a support shaft which serves as a rocking center provided at a position at which two arms among the two pairs of arms make it possible to use web rolls alternately.

* * * * *